United States Patent [19]

Ramer

[11] 4,288,102

[45] Sep. 8, 1981

[54] EXTENSIBLE SKI POLES WITH HAND GUARD GRIP

[75] Inventor: Paul C. Ramer, Golden, Colo.

[73] Assignee: Alpine Research, Inc., Golden, Colo.

[21] Appl. No.: 19,829

[22] Filed: Mar. 12, 1979

[51] Int. Cl.[3] ..... A63C 11/22

[52] U.S. Cl. ..... 280/823; 135/66; 280/821

[58] Field of Search ..... 280/11.37 H, 11.37 F, 280/11.37 L, 11.37 D, 11.37 B, 11.37 N, 11.37 E, 819, 820, 821, 822, 823, 816; 135/66, 65

[56] References Cited

U.S. PATENT DOCUMENTS

| | | | |
|---|---|---|---|
| 3,479,045 | 11/1969 | Miller | 280/821 |
| 3,525,532 | 8/1970 | Baldsiefen | 280/823 X |
| 3,862,765 | 1/1975 | Goheen | 280/821 |
| 4,062,554 | 12/1977 | Korger | 280/821 |
| 4,172,601 | 10/1979 | Hutter | 280/821 X |

FOREIGN PATENT DOCUMENTS

| | | | |
|---|---|---|---|
| 168455 | 6/1951 | Austria | 280/11.37 B |
| 1502548 | 10/1967 | France | 280/11.37 F |
| 64221 | 6/1943 | Norway | 280/11.37 D |
| 239228 | 12/1945 | Switzerland | 280/11.37 D |
| 239402 | 1/1946 | Switzerland | 280/11.37 H |
| 598842 | 5/1978 | Switzerland | 280/11.37 H |

*Primary Examiner*—Joseph F. Peters, Jr.
*Assistant Examiner*—Milton L. Smith
*Attorney, Agent, or Firm*—Gary M. Polumbus

[57] ABSTRACT

A pair of ski poles, each having a shaft of two portions releasably connected to each other and to a unique grip. Each of the two portions of the shaft telescope one within the other to any one of a number of predetermined positions. The pair of ski poles are further adapted to disconnect from the grip and allow portions of the shaft to be reconnected to the other shaft, forming a relatively longer avalanche probe. The grip has an arresting spur thereon to assist a skier in stopping his momentum after a fall on a hill.

6 Claims, 7 Drawing Figures

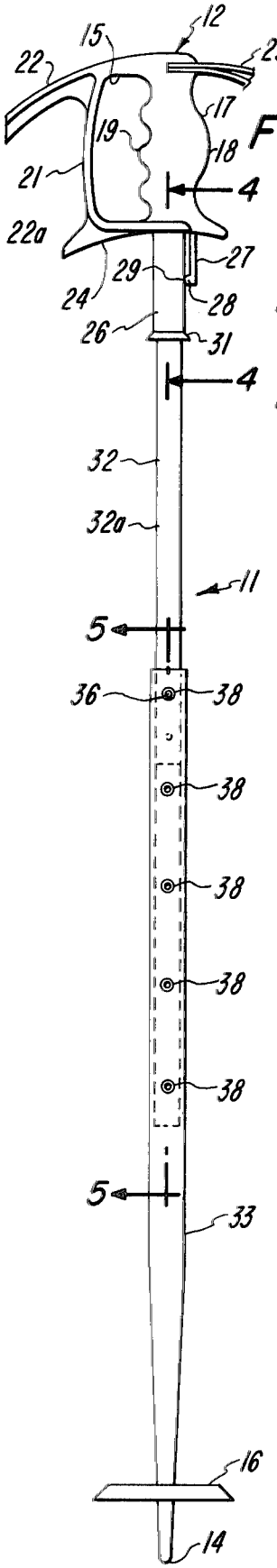
Fig_1
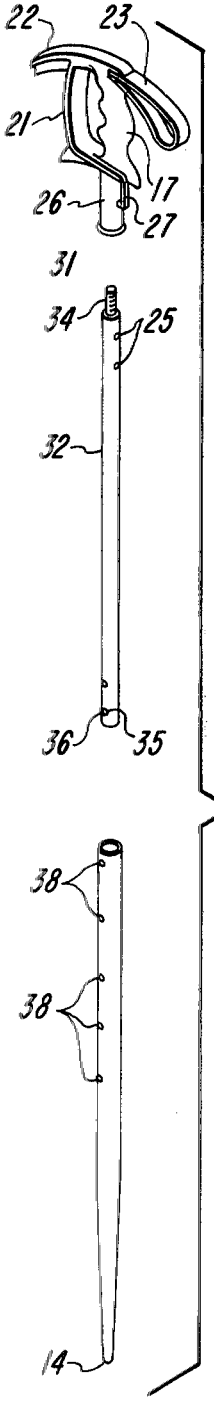
Fig_2
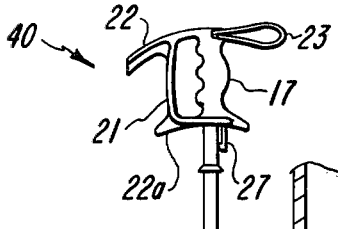
Fig_3
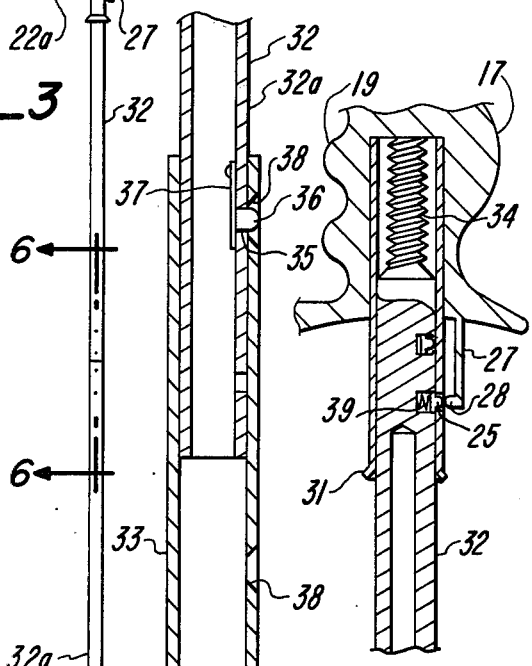
Fig_4
Fig_5
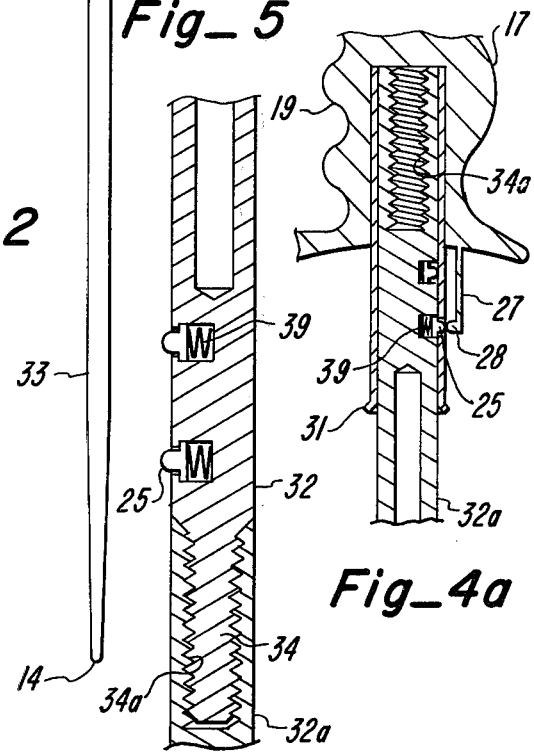
Fig_4a
Fig_6

EXTENSIBLE SKI POLES WITH HAND GUARD GRIP

BACKGROUND OF THE INVENTION

1. Field of the Invention

The present invention relates to ski poles for use in either down-hill or cross-country skiing. More particularly, the invention relates to a ski pole that is adaptable to both types of skiing and further capable of use as an extended avalanche probe.

2. Description of the Prior Art

Heretofore, utilization of one type of ski pole for a particular type of skiing, cross-country or down-hill, has been the rule of thumb with a cross-country ski pole being longer than a down-hill pole. This length difference has been dictated by innate differences between the two sports.

Down-hill skiing requires rapid turning, accomplished to a great extent by the skier's lowering and raising of his or her center of gravity and further by "planting" the ski pole. These maneuvers are most readily accomplished by having a ski pole of a length between the waist and shoulder of the user. In cross-country skiing, the arms, and therefore the poles, are a direct motive force. The ski poles are correspondingly longer, being generally slightly less than shoulder height. The present invention provides a variable length ski shaft so that a single pole can be used in both sports.

There are additional safety concerns in both sports that the present invention addresses. With respect to down-hill skiing, falling is a necessary risk in the sport. Momentum after a fall carries a skier down the hill in a potentially injury producing slide. The novel construction of the grip of the present invention includes an arresting spur, which can dig into the snow, slowing a sliding skier. The grip also includes a hand guard which protects the fingers of a fallen skier from abrasion.

The danger most prevalent in cross-country skiing but also existant in down-hill, is the danger of being buried under an avalanche of snow. Under such conditions the skier must be located by feel, probing the mass of fallen snow. If a companion is nearby, and saw the buried skier go under the snow, the normal method of locating the buried skier is the use of the conventional ski pole. The present invention is adaptable to increase the length of one of a pair of poles, by connection to a portion of the other pole. This greatly increases the available probe length and increases the depth of snow that can be searched.

Therefore, it is an object of the present invention to provide ski poles that are of variable length for use in either down-hill or cross-country skiing.

It is a further object of the present invention to provide a ski pole that can be extended in length to form a relatively longer shaft for use as an avalanche probe.

It is another and further object of the present invention to provide for protection to the fingers and hands of a fallen skier and provide means for inhibiting sliding motion after a fall.

SUMMARY OF THE INVENTION

A pair of extensible ski poles each having a cutlass guard type grip releasably connected to a multi-piece shaft is disclosed. The shaft has upper and lower portions which are selectively releasable from each other. Removal of the cutlass type grip from the upper portion of the shaft exposes either an externally or internally threaded end which is adapted to screw into or onto a threaded end of the corresponding upper portion of the other ski pole shaft. In this manner a three piece shaft is formed having at one end a tip for penetrating the snow. The end opposite the tip can receive one of the previously removed cutlass type guards or alternatively the remaining lower portion of the shaft. The resulting longer structure is particularly well suited for use as an avalanche probe once a conventional basket is removed from the end near the tip of the shaft.

The upper portion of each shaft telescopes within the lower portion. Both the upper and lower portions are hollow except for one end of the upper portion which is of solid material and is threaded, one upper portion being internally threaded and the other externally threaded. The threaded ends have self retained release buttons a short distance below the threads which are adapted to fit into a retainer hole located in a guard support sleeve held within the cutlass type grip.

The lower end of each upper portion has a leaf spring biasing a shaft extension and release button out through a hole in the upper portion. The shaft extension and release button, once the upper portion of the shaft is inserted within the lower portion, engages any of a plurality of extension holes located along the length of the lower portion.

A detent arm and head extend downwardly from the cutlass type grip to a point adjacent to the guard release button. Actuation of the detent arm permits insertion of the head into the sleeve detent hole and recesses the guard release button permitting the cutlass grip and guard support sleeve to be withdrawn from the upper portion.

The cutlass type grip itself is uniquely constructed having a hand guard and arresting spur integrally associated with a relatively conventional hand grip. The arresting spur extends downwardly in a curving nature away from the top of the grip. The fingers of a skier are protected by the hand guard which surrounds the fingers a short distance away from the gripping portion itself.

BRIEF DESCRIPTION OF THE DRAWINGS

FIG. 1 is a side elevation of one of the pair of ski poles of the present invention.

FIG. 2 is an exploded perspective view of one of a pair of ski poles of the present invention.

FIG. 3 is a side elevation of one of the pair of ski poles of the present invention having the upper portion of the shaft of the other pole attached thereon, as for use as an avalanche probe.

FIG. 4 is an enlarged fragmentary section taken along line 4—4 of FIG. 1.

FIG. 4*a* is an enlarged fragmentary section similar to FIG. 4 for the other ski pole.

FIG. 5 is an enlarged fragmentary section taken along line 5—5 of FIG. 1.

FIG. 6 is an enlarged fragmentary section taken along line 6—6 of FIG. 3.

DESCRIPTION OF PREFERRED EMBODIMENT

A pair of substantially similar ski poles 11 is disclosed. Each ski Pole is embodied with a uniquely shaped cutlass guard type grip 12, releasably connected to a hollow tubular shaft 13, which shaft 13 converges to a tip 14 at the opposite end from the grip. A conventional basket 16 is removably connected to the shaft a short distance from the tip 14.

The cutlass guard type grip 12 has as a primary component a grip portion 17 which is designed with a hollow tubular interior opening only through the bottom of the grip. The grip portion 17 is similar to those grips currently in wide use in both down-hill and cross-country skiing, being of generally cylindrical shape with a rounded backside 18 formed to comfortably fit within the palm of a skier's hand. Opposite the rounded backside 18 are finger rests 19 conformably fitting to the fingers of a hand wrapped around the grip portion 17.

Disposed in spaced relationship from the finger rests 19 is a hand guard 21 of elongated, slightly arcuate configuration sufficient to protect the fingers and hands of a skier from abrasive contact with snow or ice upon a fall. Protruding away from the uppermost extent of the hand guard 21 in a direction away from the grip portion 17 is a downwardly curved arresting spur 22 forming an acute angle with the grip. The arresting spur is particularly suited to assist a down-hill skier in halting his momentum after a fall. This claw-like extension can be readily gouged into the snow with a resulting braking effect. Attached to the top end of the grip portion 17 of the grip is a conventional hand strap 23 through which the skier slips his hand so as not to lose the pole if he looses his grip on the pole. The opposite end of the grip 17 has a lower restraint 24 which is continuous with the hand guard 21 and has an ancillary spur 24*a* extending parallel to the arresting spur 22. A hand opening 15 for the cutlass guard type grip 12 is thereby defined by the grip portion 17, the lower restraint 24 and the hand guard 21.

The entire cutlass grip 12 and associated portions thereof, as previously described, may be made from a single step molding process. Preferably, the grip and associated parts thereof are made of nylon.

A guard support sleeve 26 is securely positioned within the hollow interior of the grip portion 17. The guard support sleeve 26 is of a tubular shape extending substantially the entire length of the grip portion 17 and protruding downwardly away therefrom a distance approximately $\frac{2}{3}$ the length of the grip portion 17 (FIGS. 4 and 4*a*). A semi-rigid detent arm 27 forms a downward cantilever extension from the lower restraint 24 immediately adjacent to the rounded back-side 18 of the grip portion 17. The detent arm 27 runs parallel to the guard support sleeve and has its lower free end terminating in a rounded head 28. A sleeve retainer hole 29 is provided in the guard support sleeve 26 adjacent to the head 28 so that the head can be forced into the hole 29 to release one of a pair of guard release buttons 25 carried on the shaft 13. As will be discussed more fully hereinafter, the detent arm 27 can be manually depressed by a user for purposes of providing quick release disconnect of the cutlass guard grip 12 from the shaft 13. The detent arm 27 is therefore required to flex between a rest position, FIG. 4, and a disconnect position wherein the head 28 is inserted into the hole 29. The guard support sleeve 26 terminates at its lowermost end in a divergent skirt 31 provided for the purpose of guiding the shaft 13 into the guard support sleeve 26.

The shaft 13 of each pole 11 has two separable portions, upper portions 32 and 32*a*, which are similar but not indentical elements of substantially hollow tubular construction, and identical lower portions 33 also of tubular construction which converge to the tip 14. The upper portions 32 and 32*a* are received in the guard support sleeve 26 to join the shaft 13 to the cutlass guard grip 12. Each of the upper portions 32 and 32*a* has upper threaded ends 34 and 34*a* respectively which extend into the guard support sleeve 26 of the associated grip. Those ends, 34 and 34*a*, of the upper portions are of solid material, to the extent they extend into the guard support sleeve 26, so that one end is externally threaded and the other internally threaded (FIGS. 4 and 4*a*). Each threaded end is thereby threadably connectable to the other for purposes to be discussed more fully hereinafter.

The plugged or solid material area of each of the upper portions 32 and 32*a* beneath the threaded ends 34 and 34*a* has the release buttons 25 incorporated therein. Each release button is biased laterally away from the plugged area of the upper portions 32 and 32*a* of the shaft 13 by a release spring 39. The self-retained release button 25 is dimensioned and sized to protrude laterally away from the upper portion 32 or 32*a* into the sleeve retainer hole 29 of the guard support sleeve 26. In this manner once the threaded ends 34 and 34*a* are inserted into the guard support sleeves 26, one of the release buttons 25 can be urged into the sleeve retainer hole 29, positively connecting the guard support sleeve 26 to the upper portions 32 and 32*a* of the shaft 13. Actuation of the detent arm 27 and associated head 28 depresses the guard release button 25 and biases the release springs 39, permitting removal of the guard support sleeve 26 and associated cutlass guard grip 12 from the shaft 13. More than one guard release button 25 is provided so as to permit variation of the length of the entire ski pole 11 (FIG. 4).

On the lower end, opposite the threaded ends 34 and 34*a*, of the upper portions 32 and 32*a* of each shaft 13 is a shaft extension and release button 36. The shaft extension and release button 36 is substantially near the lower hollow end of the upper portions 32 and 32*a* of the shaft. As best seen in FIG. 5, the shaft extension and release button 36 extends through hole 35 in the upper portions 32 and 32*a* and is yieldingly held in that position by a leaf spring 37, which is riveted to the interior surface of the lower hollow end of the upper portions 32 and 32*a* of the shaft 13.

The upper portions 32 and 32*a* of the shafts 13 are so dimensioned at their lower ends as to be telescopically receivable within the open upper end of the lower portions 33 of the shafts 13. The lower portions 33 have a plurality of extension holes 38 disposed along their length near the upper end. The lower portions 33 are of hollow tubular construction and downwardly convergant toward the tip 14. The shaft extension and release button 36, disposed on the hollow lower end of the upper portions 32 and 32*a*, is insertable into any one of the lower portion extension holes 38 permitting manual selection and adjustment of the overall length of the shaft 13 or total release of the two portions 32 or 32*a* and 33, for the purpose of using the invention as an avalanche probe 38 (FIG. 3), as will be discussed hereinafter. It will be appreciated by those experienced in the sports of down-hill and cross-country skiing, that a down-hill ski pole is relatively short in comparison to the pole used for cross-country skiing. By its variable length, the present invention therefore provides the capability of being utilized in either sport.

Disposed near the tip 14 of the lower portion 33 of the shaft 13 is the conventional basket 16. The basket 16 is releasably held on the shaft 13 in any suitable manner. As will be discussed more fully hereinafter, when used as an avalanche probe 40 the basket 16 is removed from the lower portion 33 of the shaft to facilitate penetration of a snow mass.

In assembly for normal cross-country or down-hill skiing uses, the cutlass type grips 12 and associated guard support sleeves 26 are slipped over the respective threaded ends 34 and 34*a* of the upper portions 32 and 32*a* of the shaft 13. Ease of assembly between the cutlass type grips 12 and the upper portions 32, and 32*a* is insured by the converging geometry of the underside of skirts 31. One of the guard release buttons 25 on each pole is then matched with the sleeve retainer hole 29 on that pole and is urged into the hole 29 by the guard release spring 37, thereby positively securing the cutlass guard grips 12 to the upper portions 32 and 32*a* of the shaft 13.

In a like manner, the upper portions 32 and 32*a* of the shaft 13 are inserted slidably within the interior of the lower portions 33 by depressing the shaft extension and release button 36. A user will then adjust the pole length by selecting one of the lower portion extension holes 38 to receive the shaft extension and release button 36 to thereby interlock the upper and lower portions. The basket 16 is then releasably secured in a conventional manner to the lower portion 33 and the ski pole 11 is ready for use. Additional variation of length can be gained by using a different guard release button 25 to adjust the extent to which the guard support sleeve 26 overlaps the upper portion 32 of the shaft 13. (As best seen in FIGS. 4 and 4*a*).

When the present invention is utilized in an emergency situation as an avalanche probe 40 (FIG. 3) for purposes of locating individuals trapped under a snow fall by "feel", similar procedures as outlined above are used to construct an avalanche probe 40. The cutlass guard grips 12 are removed from the upper portions 32 and 32*a* of both of the ski poles 11. This is quickly and easily done by depressing the detent arm 27, which in turn depresses the guard release button 25, and sliding the cutlass guard grip 12 off of the threaded ends 34 or 34*a* of the respective upper portions 32 and 32*a*.

The upper portion 32 and 32*a* of one of the ski poles 11 is then removed from the corresponding lower portion 33. The upper portion 32 or 32*a* so removed, is then inverted and threadably connected to the upper portion 32 or 32*a* and associated lower portion 33 of the other shaft 13 forming thereby an extended length of shaft.

The resulting three section shaft is approximately 50% longer than a single pole length, which can be a critical difference in deep snow. The avalanche probe 40 is completed by adding one of the cutlass type grips 12 to the upper portion 32 or 32*a*. The same shaft extension and release button 36 that was used to adjust the length of the shaft 13 can now be utilized to protrude into the sleeve retainer hole 29 of the guard support sleeve 26. It is readily apparent from the foregoing that the remaining lower portion 33 could be added to the three section shaft instead of a cutlass type grip 12. This would give even additional length for the probe but at some sacrifice to the handling of the avalanche probe 40.

It will be understood that changes may be made in the details of construction, arrangement and operation without departing from the spirit of the invention, especially as defined in the following claims.

What I claim is:

1. A pair of ski poles, each ski pole comprising, in combination:

a hand grip having a gripping portion and a hand guard operatively connected to and extending a predetermined parallel distance along said gripping portion, said hand guard terminating near the uppermost portion of said gripping portion, and a downwardly curving arresting spur extending at an acute angle downwardly away from said hand guard and said grip;

a shaft operatively connected to said hand grip; and a basket operatively connected to said shaft.

2. A pair of ski poles, each ski pole comrpising, in combination:

a hand grip;

a flexible detent arm operatively connected to said hand grip and extending longitudinally away therefrom, said detent arm having an enlarged head on the free end thereof;

a tubular guard support sleeve contained within said hand grip and having a retainer hole therein laterally adjacent to said head on said detent arm;

a shaft upper portion having a solid threaded end, one of said poles having an externally threaded solid end and the other an internally threaded solid end, said upper portions containing therein a spring biased release button adapted to be received by said retainer hole, said threaded end of said upper portion being receivable in said guard support sleeve, said upper portion extending longitudinally away from said guard support sleeve and having a hollow tubular portion being substantially longer than the solid portion, said hollow tubular portion having an open end with a shaft extension and release button protruding therethrough;

a shaft lower portion having a tip at its lowermost end, and an open upper end, said upper portion being selectively receivable within said open upper end, said lower portion further having a plurality of holes along the length thereof adapted to receive the shaft extension and release button of said upper portion to thereby releasably lock the upper and lower portions together in longitudinally variable positions, and a basket disposed along the lower portion of said shaft near the tip thereof.

3. A pair of ski poles, each pole comprising, in combination:

a shaft having a substantially tubular upper portion releasably connected to a hand grip and a tubular lower portion having a tip at its lowermost end, said upper portion being operatively connectable to said lower portion at any one of a number of longitudinally adjustable positions to thereby vary the length of said shaft, said hand grip further containing a tubular guard support sleeve having a retainer hole therethrough, said upper portion further including a spring biased guard release button, said guard release button biased into the retainer hole of said support sleeve, said upper portion being slidably receivable within said support sleeve whereby said release button can be extended into said retainer hole to connect said upper portion to said support sleeve, said hand grip having fixedly mounted thereon one end of a detent arm extending parallel to said support sleeve, the other end of said detent arm terminating in a head positioned so as to be laterally adjacent to said guard release button and said retainer hole to thereby permit removal of said hand grip and support sleeve from said upper portion of said shaft upon deflection of said detent arm into said retainer hole; and a basket disposed along the lower portion of said shaft near the tip thereof.

4. The invention as defined in claim 3 wherein the upper portion of one pole of said pair has an externally threaded end of non-tubular construction, and the other pole of said pair has an internally threaded end, both of said threaded ends being slidably receivable within the support sleeve of a grip whereby removal of said grip permits a threadable connection to be made between the threaded ends of the upper portions of each pole of the pair.

5. The invention as defined in claim 4 wherein said release buttons are self-retained within the solid ends of said upper portions.

6. In a ski pole of the type having a shaft of substantially tubular configuration terminating in a tip at the lowermost end and a basket disposed along said shaft near the tip thereof, a hand grip releasably connected to said shaft, the improvement comprising:

a gripping portion of said hand grip having upper and lower ends;

a lower restraint integrally connected to and extending away from the lower end of said gripping portion;

a hand guard rising from said lower restraint in parallel spaced relationship with said gripping portion; and a claw-like extension integrally extending from the upper end of said gripping portion to connect to the hand guard, said claw-like extension extending at an acute angle with respect to said shaft downwardly from said grip and said hand guard.

* * * * *